US006592464B1

(12) United States Patent
Helstrom

(10) Patent No.: US 6,592,464 B1
(45) Date of Patent: Jul. 15, 2003

(54) WINTER GOLF DRIVING RANGE

(76) Inventor: Jeffrey C. Helstrom, 8276 Scandia Rd., Waconia, MN (US) 55387

( * ) Notice: Subject to any disclaimer, the term of this patent is extended or adjusted under 35 U.S.C. 154(b) by 0 days.

(21) Appl. No.: 10/005,774

(22) Filed: Nov. 2, 2001

Related U.S. Application Data

(63) Continuation-in-part of application No. 09/298,339, filed on Apr. 23, 1999, now Pat. No. 6,325,726.

(51) Int. Cl.[7] ..... A63B 69/36
(52) U.S. Cl. ..... 473/168
(58) Field of Search ..... 473/167–170

(56) References Cited

U.S. PATENT DOCUMENTS

| | | | | |
|---|---|---|---|---|
| 1,745,201 A | | 1/1930 | Alston | |
| 2,043,273 A | | 6/1936 | Watson | |
| 2,248,053 A | * | 7/1941 | Bales | 473/168 |
| 2,805,070 A | | 9/1957 | Waters | |
| 3,231,260 A | | 1/1966 | Collins | |
| 3,310,310 A | | 3/1967 | McKee | |
| 3,464,703 A | | 9/1969 | Vallas | |
| 3,599,980 A | | 8/1971 | Harmond et al. | |
| 3,649,025 A | | 3/1972 | Garland | |
| 3,861,680 A | | 1/1975 | Mowrer | |
| 4,750,744 A | | 6/1988 | Michalec | |
| 5,011,152 A | | 4/1991 | Hugunin | |
| 5,547,186 A | | 8/1996 | Papp et al. | |
| 5,588,652 A | * | 12/1996 | Lang | 473/168 |
| 6,325,726 B2 | * | 12/2001 | Helstrom | 473/168 |

* cited by examiner

*Primary Examiner*—Mark S. Graham
(74) *Attorney, Agent, or Firm*—Haugen Law Firm PLLP

(57) ABSTRACT

A portable all-weather golf driving range which is designed to removably cover a conventional golf driving range or fairway with a netting includes a number of ball receiving bores formed therein to permit balls to be conveniently and automatically collected through motion induced by gravity from the configuration of the netting. When in position, the netting is configured in its elevation by the plurality of netting sections, preferably in reticulated form, with support posts elevating the netting at distinct desired locations, such that the ball receiving bores are disposed at relatively lower positions between the support posts.

9 Claims, 4 Drawing Sheets

WINTER GOLF DRIVING RANGE

CROSS-REFERENCE TO RELATED APPLICATION

The present application is a continuation-in-part of our application Ser. No. 09/298,339, filed Apr. 23, 1999, now U.S. Pat. No. 6,325,726 entitled "WINTER GOLF DRIVING RANGE", and assigned to the same assignee as the present application.

FIELD OF THE INVENTION

Outdoor golf driving ranges are popular recreational gathering or congregation spots for those interested in either improving their golf game or simply hitting some golf balls as a way of relaxing. In climates where late fall or winter brings with it snow and cold weather, a typical outdoor golf driving range will be forced to close for the duration of the inclement weather season for any number of reasons, the least of them being other than the presence of snow on the ground. During the summer, outdoor golf driving range operators can, in a fairly efficient fashion, collect driven or hit balls either by hand or through the use of various self-propelled mechanical pick-up devices. In the winter, snow and cold create miserable weather conditions which make most conventional collection methods impossible or at least impractical since a hit ball may be lost in several inches or more of snow and/or ice. Further, the presence of accumulated snow makes the use of most conventional mechanical collection devices impractical. Additionally, the presence of snows hinders manual collection in at least two ways. First, since the ball may be buried in snow, in whole or in part, the ball may very well be difficult to spot from above even if it is of a contrasting or different color than the snow. Secondly, the very fact that snow is on the ground will, doubtlessly, either hinder or make it impossible for the collector to locate the balls. Accordingly, it is a principle objective of this invention to provide a golf driving range which is usable during the snowy and inclement weather months, and which allows for the efficient retrieval of hit balls by the range operator. In addition, it is a further objective of this invention to provide a portable golf driving range that is usable during snowy and inclement weather months, the portability allowing utilization of land not otherwise widely usable in the winter months, while returning full use of the land during warmer-climate seasons.

DESCRIPTION OF THE PRIOR ART

In the past various techniques have been utilized for providing indoor all-season golf facilities. While enclosed air-inflated domes have been utilized, they nevertheless provide limitations of size which, in turn, restricts the golfer in his ability to observe the overall trajectory of the ball beyond the limitations imposed by the dome-size. The economics of the situation are such that it is impractical and financially unsound to utilize an inflatable dome structure which is large enough to eliminate the limitation and constraint of size.

Additionally, in U.S. Pat. No. 3,861,680, there is disclosed a system which provides for some limited utilization of a cold weather golf driving and/or practice range. The system disclosed in U.S. Pat. No. 3,861,680 utilizes a series of inverted "v" screens which carry yardage indicia, and which are necessarily positioned as a abutment plate or barrier for substantially free flight of the ball to a landing point. The system disclosed presents some difficulties in ball retrieval, particularly when considering the inherent limitations of dimensional configuration. The arrangement of the present invention eliminates these disadvantages and provides a golf practice facility which may be utilized all year-round in areas where climatic conditions result in harsh winters. Furthermore, the present invention provides a portable golf practice facility which may be quickly assembled and disassembled at desired times.

SUMMARY OF THE INVENTION

In accordance with the present invention, a golf practice driving range and facility is revealed which utilizes a heated open-ended enclosure for accommodating the golfer particularly in cold and/or inclement weather. The field is essentially unlimited in size and configuration, being conveniently placed on an existing golf fairway or driving range, and for ball retrieval purposes is covered with a network of netting having a configuration with a plurality of recesses or troughs having a bottom or low point with a ball retrieving opening formed therein. While not being essential or critical, the configuration is such that an arrangement or pattern of generally upright posts is provided for creating a support for the network of netting, and thus creating a means for utilizing gravity to cause flow and movement of golf balls to a collection and/or transfer point located beneath each ball retrieving opening in the netting. The covering surface is preferably in the form of plastic film netting or reinforced scrim-like material perforated or reticulated pattern of openings of sufficiently small dimensions so as to reduce any interference with the free movement of the ball across the surface toward one of the ball retrieval openings. The perforated plastic film netting is configured so that golf balls are retained, but snow, ice, and other weather related materials are able to pass through the openings formed in the netting.

Although the size and configuration of the overall installation is virtually unlimited, it is appreciated that the installation can be achieved and accomplished without the need for extensive grading or reworking of the earth or ground surface, thereby being environmentally friendly and ecologically sound. The installation is straightforward and the general configuration of the terrain of the base is preferably replicated in the covering surface. Installation is preferably accomplished through the use of a plurality of post receptacles positioned in the ground for removable securement of respective posts therein.

IN THE DRAWINGS

DESCRIPTION OF THE PREFERRED EMBODIMENT

Figure 1:
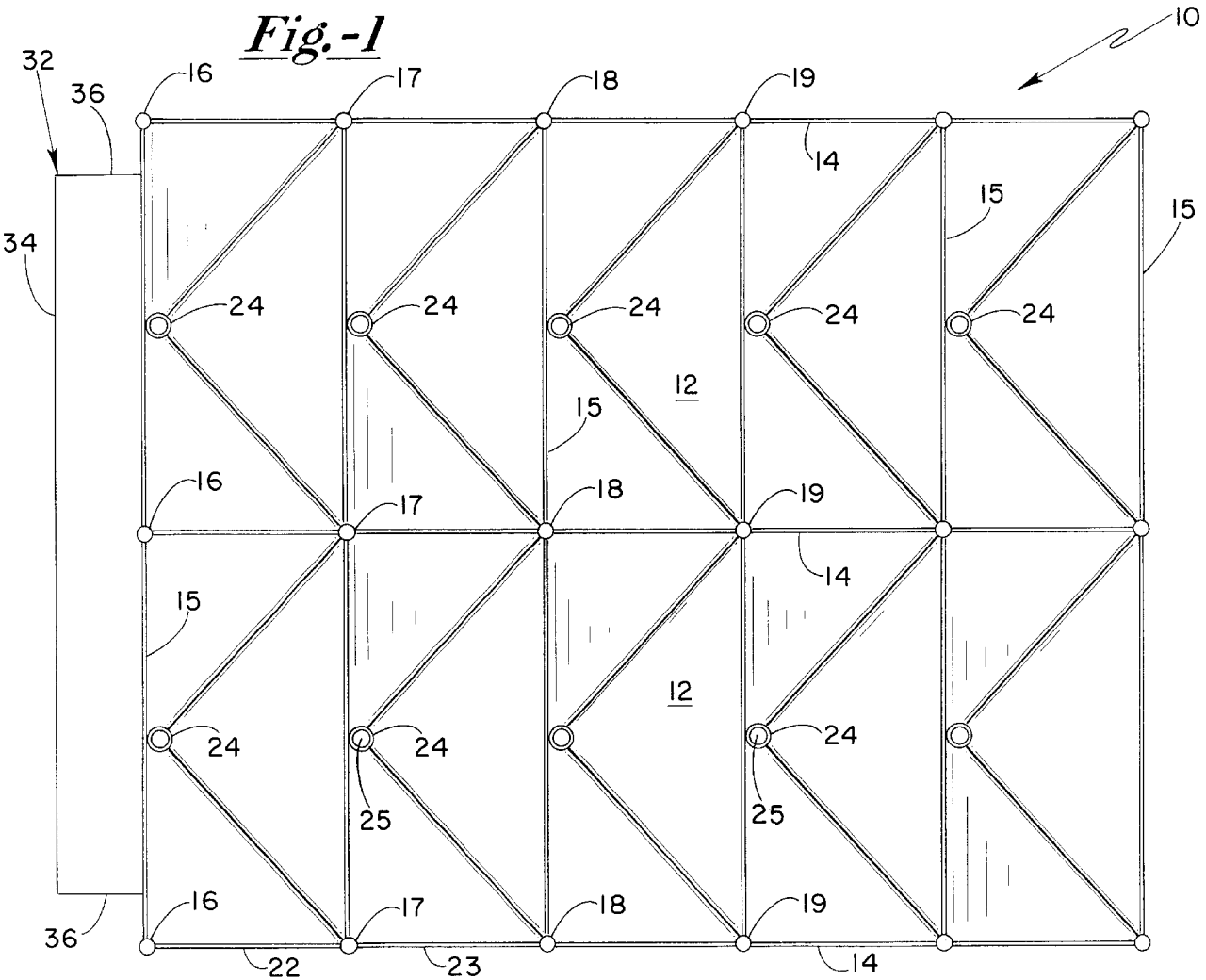
FIG. 1 is a top plan view of a typical driving range arranged and constructed in accordance with the invention.

Referring now to the General Description drawings, in FIG. 1 the driving range of the present invention is shown at 10, including a ground-covering area-wide net 12 which is supported by a network or plurality of longitudinal and lateral cables 14—14 and 15—15, respectively, arranged in an x-y grid pattern. Cables 14—14 are not necessarily taut, but may be arranged in a slight or modified catenary configuration, and are utilized between sets of relatively low front or forward posts, and sets of relatively higher back or rearwardly disposed posts. The arrangement of the front and rear posts are illustrated in the side elevational view of FIG. 4, with one such set of posts being shown at 16—16 and 17—17. The front posts are typically elevated to a level which is about two feet below the plane of the tee at the forward end, such as approximately two feet off the surface of the ground for a tee positioned approximately four feet off the ground. The rear posts are at a graduated or increasingly higher elevation when measured from the first such set as at 17—17, to the more distant sets 18—18 and 19—19.

Laterally extending or transverse cables 15—15 are utilized to support the netting across the width of the range, with respective intermediate posts being provided to assist in reducing sagging of the netting due to the load and assumed catenary configuration. The transverse cables are under tension and held taut in order to provide a substantially planar netting surface. Each individual net segment, such as segments 22 and 23 is provided with a ball passing ring as at 24, with the ring, and its inherent weight, creating and defining the low-point of each net segment, so as to provide a location where golf balls landing upon the net segment will migrate or roll under the influence of gravity. Each net segment is draped or attached at its edge surfaces to the support cables, including the longitudinal support cables 14 and the transverse cables 15. Spaced hooks, clasps, rollers, tie points, or other known slidable attachment means are utilized to slidably secure the individual netting segments to the edge-disposed lateral and longitudinal support cables.

A series of alternately positioned short/high posts are positioned on the exterior of the driving range. This post arrangement is provided in order to provide a longitudinally oriented graduated pattern for the net segments, with the elevation of the rear edges of each succeeding net segment being stepped up as the distance from the driving tee increases. While the front/lower posts position the netting generally between about two feet and four feet in height (assuming a 4' elevation for the tee deck), the rear/high posts may be between about 6 feet and 15 feet high for the first segment, and increasing to a height of about 50 feet at the rear segment. This height arrangement has been found satisfactory for ranges having a length of up to about 200 yards, with golf balls making contact with the netting before passing beyond the most distant net.

Figure 3:
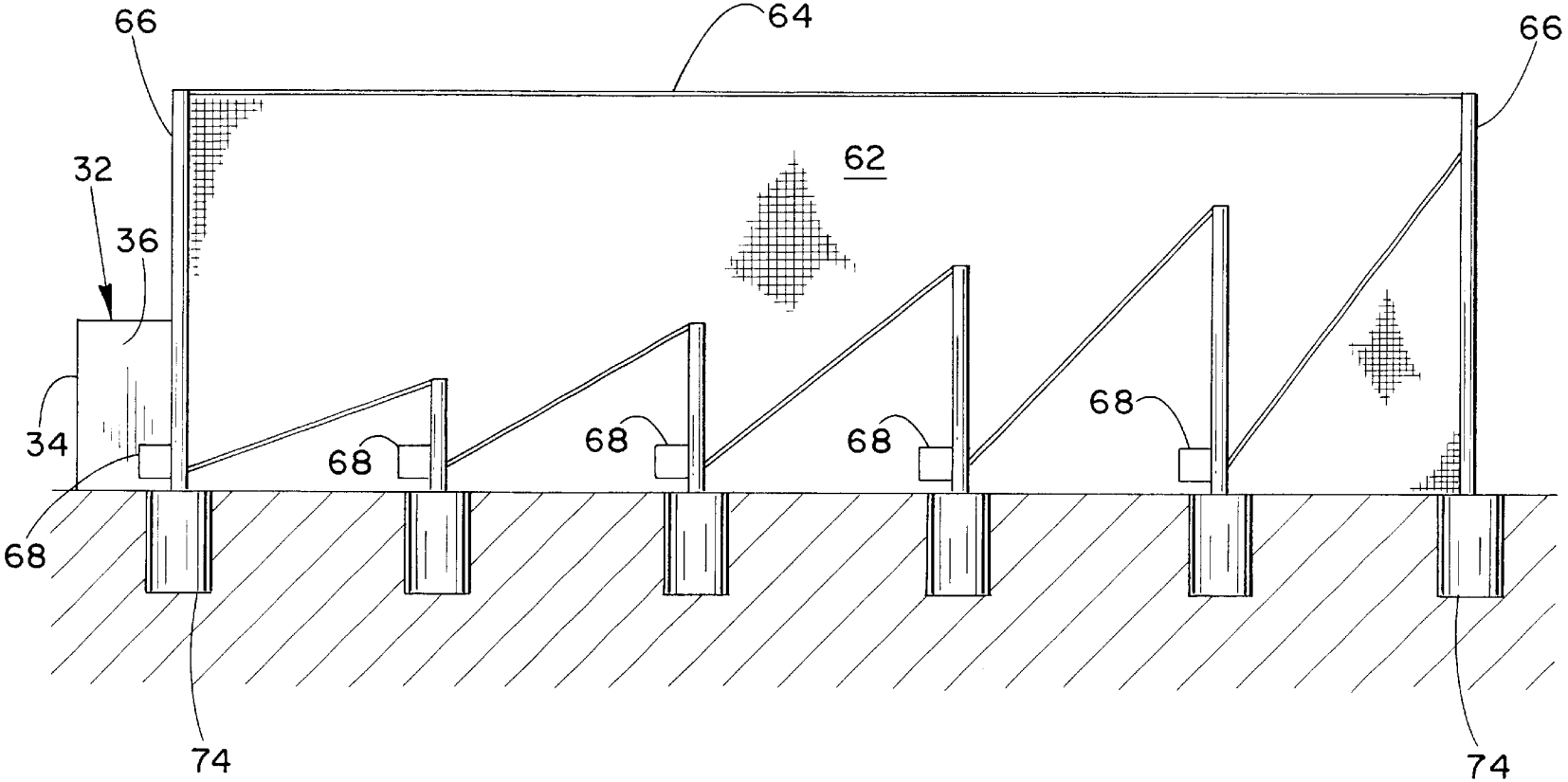
FIG. 3 is a side view of the driving range of the present invention showing perimeter posts supporting perimeter netting surrounding the golf driving range.

As shown in FIG. 3, perimeter draped netting 62, which is ball impermeable, serves the dual purpose of the defining the range while at the same time insuring that errantly hit balls are kept within the confines of the range and not lost in the snow, or being launched into an area where people, automobiles or other property may be struck by hooked, sliced or other errantly hit balls. Netting 62 is suspended from a cable 64 which is typically positioned about 50 feet off the ground. The lateral netting (not shown), as well as the rear span are attached to a series of posts and define catenary netting suspending sections. It will be appreciated that these cable spans may be positioned at any desired height from the ground, with a height of no less than about 50 feet being generally desirable and acceptable.

The exterior perimeter of the range, as indicated above, is defined by draped netting 62, and suspended from individual catenary spans of perimeter defining cable 64. A three-sided golfer shelter is shown at 32, with the interior being equipped with radiant heating elements such as ceiling mounted radiant panels, radiant tubing, or the like. Such heating elements including radiant panels and tubing are well known and widely utilized in sheltered areas including interiors of indoor ice rinks and the like. Wind and waterproof exteriors are provided along the back and side panels 34, 36 of the three-sided shelter 32. A roof is, of course, provided to define the ceiling from which the heating panels are suspended, and a floor surface including an artificial grass tee-box surface is provided for the golfers using a facility, with this also providing a suitable array of spaced apart tee-boxes. Such shelters or enclosures are conventional in form.

Figure 2:
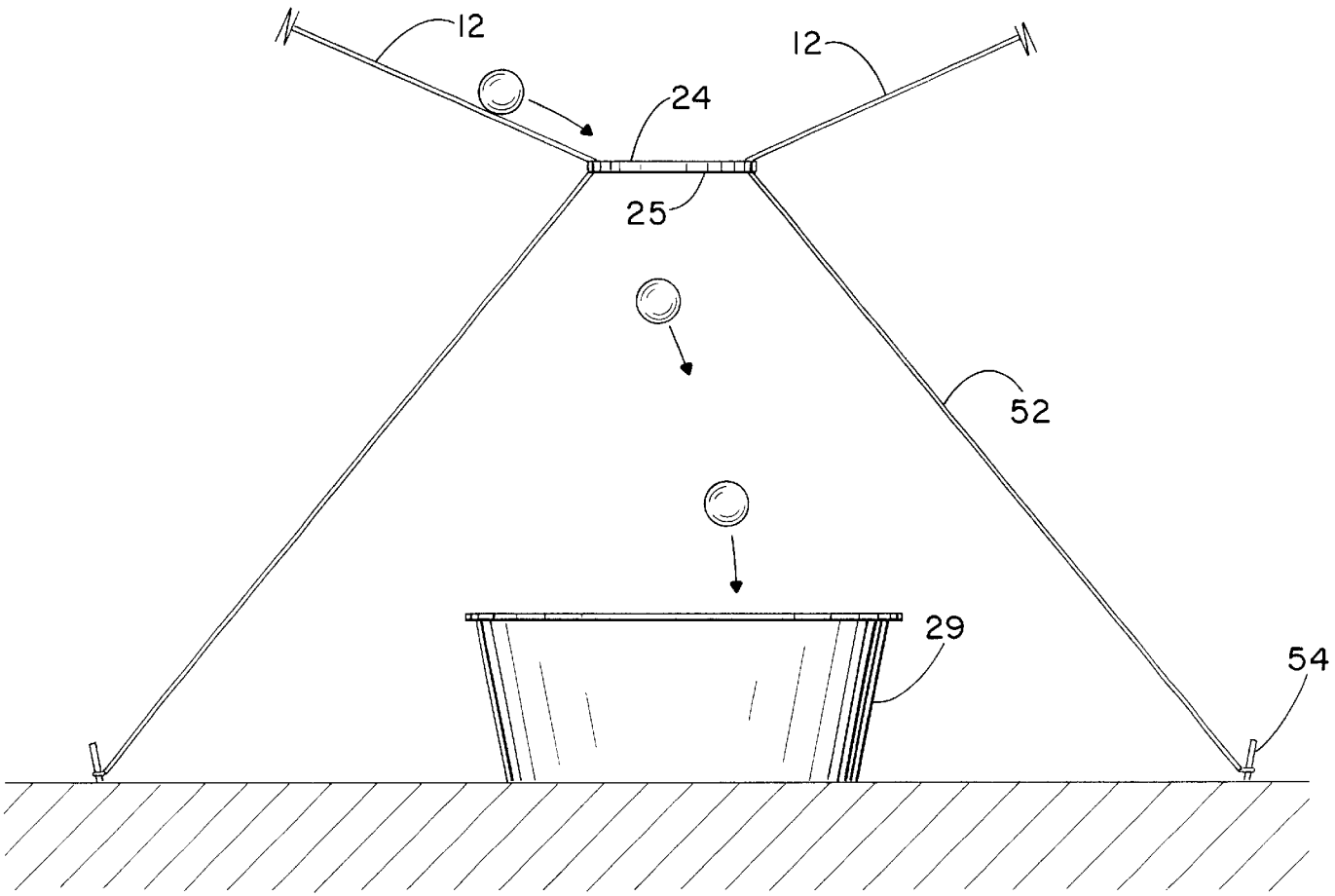
FIG. 2 is a detail elevational view partially broken away and on a highly enlarged scale of a ball collection zone and collection box component constructed in accordance with one aspect of the present invention with the box being cut away and shown in sectional view.

With attention now being directed to FIG. 2 of the drawings, a fragmentary section of netting is illustrated with a ball-passing ring member 24. Ring member 24 is of toroidal configuration, and is preferably fabricated from a relatively dense metal such as iron or the like in order to provide the sag necessary in the netting to define the opening through which the balls may pass and be collected from underneath. In other words, toroidal ring member 24 is weighted in such a way that a ball receiving opening 25 is provided to permit individual golf balls to roll along the netting and drop to a collection box or other collection mechanism positioned beneath the netting. Downward tension means 52 may be included to further drop respective ring member 24, and to hold ring member 24 in place under varying environmental conditions. Tension means are preferably held in place by retaining stakes 54 which are secured in the ground or other surface. Tension means 52 may include, for example, ⅜" diameter metal cable.

Toroidal ring member 24 may be attached to the netting through conventional means, including helically wrapped line or the like. When a golf ball is hit by a golfer from the shelter zone onto the range, it strikes the netting 12 between the individual support areas, and falls or rolls by gravity along the surface of the netting and into and through the opening 25 formed in the toroidal ring member 24. In this fashion, the ball is discharged at a centrally disposed location into a receiving or other open-top receptacle/enclosure as at 29. These individual toroidal members are positioned generally centrally of each of the net segments, thus providing a means distributed throughout the grid-like pattern for collection, retrieval, and otherwise gathering golf balls struck by the users of the facility. The individual boxes or other receptacles are periodically emptied either automatically or by hand so as to provide a continual source and recycling of the balls struck by individual golfers, and assuring a continuous supply with only a modest requirement for ball count.

Figure 4:
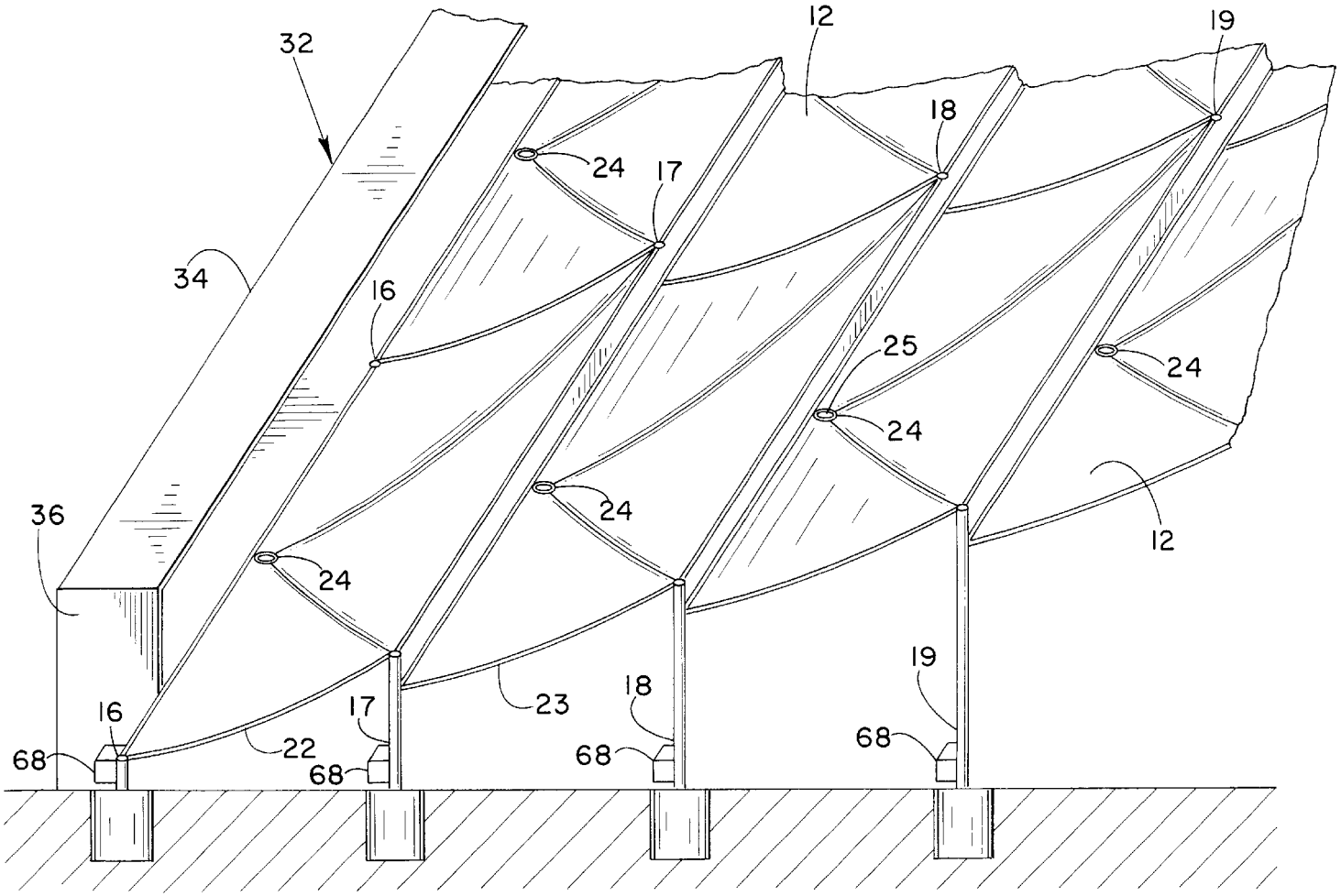
FIG. 4 is a side elevational view of a typical perimeter vertical net system and support pole and a typical horizontal net support post and anchoring means, together with a cable of the type which extends between the perimeter net support poles, illustrating the attachment of a cable winch take-up mounted on a pair of perimeter vertical net support poles.

With attention now being directed to FIG. 3, perimeter posts as illustrated at 66 are employed to deploy support and otherwise suspend drape supporting perimeter cable 64 about the periphery of the range. In a typical installation, posts 66 will be approximately 50 feet high. In one installation, posts 66 are 14 inches in diameter ASTM 53 GR material having a wall thickness of 0.375 inches. Posts 66 support a winch or cable retainer as shown at 68, with winch 68 being utilized to retract the netting whenever required for removal, repair, or protection from adverse weather conditions. The netting is carried upwardly during this retraction operation. Winch 68 typically is a power winch of conventional design. Winches 68 may be positioned at one or more vertical posts and may be positioned at each perimeter post as shown in FIGS. 3 and 4. When installed in a typical installation, perimeter support posts 66 are normally spaced about 60 feet on center.

With regard to the internal net support posts, such posts are typically elevated approximately at a recommended height about 8 feet above grade, and are fabricated from three to ten inch diameter schedule 40 pipe. Suitable base supports are, of course, placed as required for the perimeter posts 66 as well as the respective interior posts. The nature of the earth and ground support will, of course, determine the base support necessary, and this is readily determined by local mechanics working within the community and familiar with the ground support requirements. A typical subterranean support member is shown at 74 for the perimeter poles will be sunk to a depth of 14 feet and be formed of 30 inch diameter concrete with appropriately spaced vertical ties at least as close as 12 inches center. The interior posts are preferably supported by 2 foot diameter pads, typically concrete reinforced with appropriate mesh, and being about 8 inches in thickness. In a typical installation, the reticulated pattern of interior posts utilize a spacing of 30 feet on center in the longitudinal direction, and are typically positioned on center for the transverse supports. In the illustration of FIG. 1, the transverse direction is shown as north-south, with the longitudinal dimension being shown at east-west, this being, of course, merely by way of example.

In preferred embodiments of the present invention, driving range 10, including posts, cables, and netting, is portable in nature, such that driving range 10 may be erected and disassembled relatively quickly. Preferably, support members 74 constitute post receptacles for receiving respective posts therein in a sleeved configuration. Therefore, support members 74 may be permanently affixed in appropriate subterranean positions while the remainder of portable driving range 10 may be quickly removed therefrom and accordingly disassembled. In such a manner, areas having use in warm-climate activities may also be utilized in inclement-weather seasons as a golf driving range of the present invention. For example, baseball fields or golf courses that are typically unusable in inclement-weather periods may now be utilized during such periods as a golf driving range or other recreational area. The portability of the driving range of the present invention provides simple and quick disassembly when warm climate land use is desired.

In a typical installation, ⅜ inch diameter steel cable is employed for cable 64, with the maximum tension in the cables being preferably maintained at about 1000 pounds. As indicated in FIG. 3, this tension is created and maintained by winch 68.

It will be appreciated, of course, that the details of this preferred embodiment are given for purpose of illustration only, with the scope of the invention being defined by the appended claims.

What is claimed is:

1. A portable all-weather golf driving range comprising, in combination:

(a) golf ball hitting and landing zones defining a golf hole fairway, said hitting zone being positioned along a first of two opposed ends of said fairway;

(b) a primary array of posts circumscribing a perimeter of said golf fairway and with pairs of said primary posts being disposed in oppositely disposed relationship between respective end and lateral edges of said perimeter, said primary posts being arranged in a graduated, ascending height pattern along a longitudinal direction from said first end to a second distal end;

(c) a secondary array of posts including support posts disposed in spaced reticulate relationship between said primary array of posts and within said golf fairway, said secondary posts having predetermined heights corresponding to said ascending height pattern of respective said primary posts;

(d) a plurality of tensioned cable means extending across said fairway between mutually opposed primary posts above said golf fairway;

(e) a golf ball supporting net supported by, in combination, said primary posts, said tensioned cable means and said secondary posts wherein each of said secondary posts generally underlie said golf ball supporting net to form one or more upstanding apices therein, said net including at least one golf ball receiving opening formed therein at a location between respective said apices; and (f) a golf ball retrieval means positioned beneath each of said golf ball receiving openings.

2. A portable all-weather driving range defined in claim 1 being particularly characterized in that said golf ball hitting zone is a comfort shelter.

3. A portable all-weather driving range as in claim 1 wherein said golf ball receiving opening is defined by a toroidal ring member.

4. A portable all-weather driving range as in claim 1, including tension means operably coupled to said golf ball receiving opening for operably pulling downwardly upon said supporting net.

5. A portable all-weather driving range as in claim 1 wherein said graduated primary posts are at least four feet higher than respective preceding adjacent primary posts.

6. A portable all-weather driving range as in claim 5 wherein said primary posts disposed at said second distal end are about 50 feet in height.

7. A portable all-weather driving range as in claim 1, including support cables disposed about said perimeter at a pre-determined height greater than said supporting net.

8. A portable all-weather driving range as in claim 7, including catenary netting supported from said support cables around said perimeter to thereby enclose said driving range within golf ball impermeable netting.

9. A portable all-weather driving range as in claim 1, wherein said primary posts and said secondary posts are operably removably secured to respective subterranean support members, whereby said golf driving range may be quickly erected and disassembled.

* * * * *